US006067998A

United States Patent [19]

Favre

[11] Patent Number: 6,067,998

[45] Date of Patent: May 30, 2000

[54] COSMETIC BOX WITH A RETRACTABLE PROTECTIVE MASK FOR MIRROR

[75] Inventor: Bernard Favre, Chevilly Larue, France

[73] Assignee: Lir France, Chevilly Larue, France

[21] Appl. No.: 09/359,353

[22] Filed: Jul. 21, 1999

[30] Foreign Application Priority Data

Jul. 21, 1998 [FR] France ..... 98 09268

[51] Int. Cl.[7] ..... A45D 42/02

[52] U.S. Cl. ..... 132/301; 132/304

[58] Field of Search ..... 132/301, 302, 132/303, 304, 305, 306, 316, 291

[56] References Cited

U.S. PATENT DOCUMENTS

| | | | |
|---|---|---|---|
| 2,041,259 | 5/1936 | Morrison | 132/303 |
| 2,041,260 | 5/1936 | Morrison | 132/303 |
| 2,112,539 | 3/1938 | Magnus | 132/316 |
| 2,165,599 | 7/1939 | Williamson . | |
| 2,327,513 | 8/1943 | Esterow . | |

FOREIGN PATENT DOCUMENTS

| | | |
|---|---|---|
| 0 741 982 | 11/1996 | European Pat. Off. . |
| 0 750 865 | 1/1997 | European Pat. Off. . |
| 767 574 | 7/1934 | France . |
| 425533 | 4/1935 | United Kingdom . |
| 451477 | 9/1936 | United Kingdom . |

*Primary Examiner*—Todd E. Manahan
*Attorney, Agent, or Firm*—Young & Thompson

[57] ABSTRACT

A box for cosmetic products has a bottom (5) adapted to receive at least one cosmetic product, a cover (1) articulated on the bottom (5) and provided with a mirror (2) on its internal surface, as well as protective masks interposed between the bottom (5) and the cover (1) to protect the mirror (2). The masks are constituted by two flaps (6) symmetrical relative to a plane perpendicular to the axis of articulation of the cover (1) on the box (5). Each of the flaps (6) is able to pivot about an axis adjacent its end adjacent the axis of articulation and substantially orthogonal to the latter. The flaps (6) are arranged to pivot away from each other in the course of opening the cover (1) and to pivot toward each other in the course of closing the cover (1).

5 Claims, 1 Drawing Sheet

COSMETIC BOX WITH A RETRACTABLE PROTECTIVE MASK FOR MIRROR

BACKGROUND OF THE INVENTION

This application corresponds to French application 98 09268 of Jul. 21, 1998, the disclosure of which is incorporated herein by reference.

The invention relates to a box for cosmetic products of the type comprising a bottom adapted to receive at least one cosmetic product, a cover articulated on said bottom and provided with a mirror on its internal surface, as well as a protective mask interposed between the bottom and the cover to protect said mirror.

DESCRIPTION OF THE RELATED ART

Boxes of this type, constituting for example what are called a compact, are well known.

The mask is adapted to separate the mirror from the content of the bottom, which may be powder, solid cosmetic or an applicator instrument such as a powder puff or a sponge.

The protective mask can be simply positioned on the bottom but the use of the box becomes difficult because it is necessary to take off the mask and put it down, before being able to use the box.

When the mask is mounted pivotally about the hinge of the cover on the bottom, the user cannot have access to the content of the bottom except by raising the mask, which blocks the mirror and requires the user to pivot the mask in the opposite direction to be able to look at herself in the mirror and to carry out her makeup operation.

If the mask is mounted articulated on the bottom about an axis orthogonal to the axis of articulation of the cover, the preceding the drawback is overcome but the cost of the box is increased and the size, as well as the resulting imbalance rendering difficult the makeup operation.

SUMMARY OF THE INVENTION

The present invention seeks to overcome the preceding drawbacks of known makeup boxes.

To this end, the box according to the invention is characterized in that the mask is constituted by two flaps that are symmetrical with respect to a plane perpendicular to the axis of articulation of the cover on the box, each of said flaps being assembled in the box so as to be able to pivot about an axis adjacent its end adjacent said axis of articulation and substantially orthogonal to the latter.

Thus, in the box according to the invention, the two flaps of the protective mask can be spaced apart from each other, the box being open, such that the user has access simultaneously to the contents of the bottom and to the mirror.

Preferably, the flaps are arranged to pivot away from each other in the course of opening the cover and can pivot toward each other in the course of closing the cover.

The automatic pivoting of the flaps of the mask in the course of opening the cover and in the course of closing the cover can be provided for in various ways.

According to a first embodiment of the invention, the end of each flap adjacent the axis of articulation of the cover on the bottom is mounted pivotally about an axis perpendicular to the cover and comprises a heel coacting with a cam profile carried by the bottom of the box so as to cause said flap to pivot toward the open position of the mask in the course of opening the cover, a resilient return means ensuring the return of said flap to the closed position in the course of closing the cover.

The pivoting of the flaps constituting the mask about axes perpendicular to the cover ensures the holding of these flaps parallel to the cover in the course of rotations of opening and closing the cover.

Preferably, the articulated ends of the flaps comprise each a stud disposed respectively in an opening of said cover.

According to a modified embodiment, the end of each flap adjacent the articulation of the cover on the bottom is provided with a prolongation bearing on an articulation projection secured to the cover, said projection being provided with a stud coacting with a cam path on the bottom. This modification ensures the automatic pivoting of the flaps as well as the opening and the closing of the cover.

BRIEF DESCRIPTION OF THE DRAWINGS

The invention will be better understood from a reading of the following description of examples of embodiment, with reference to the accompanying drawing, in which.

DESCRIPTION OF THE PREFERRED EMBODIMENTS

Figure 1:
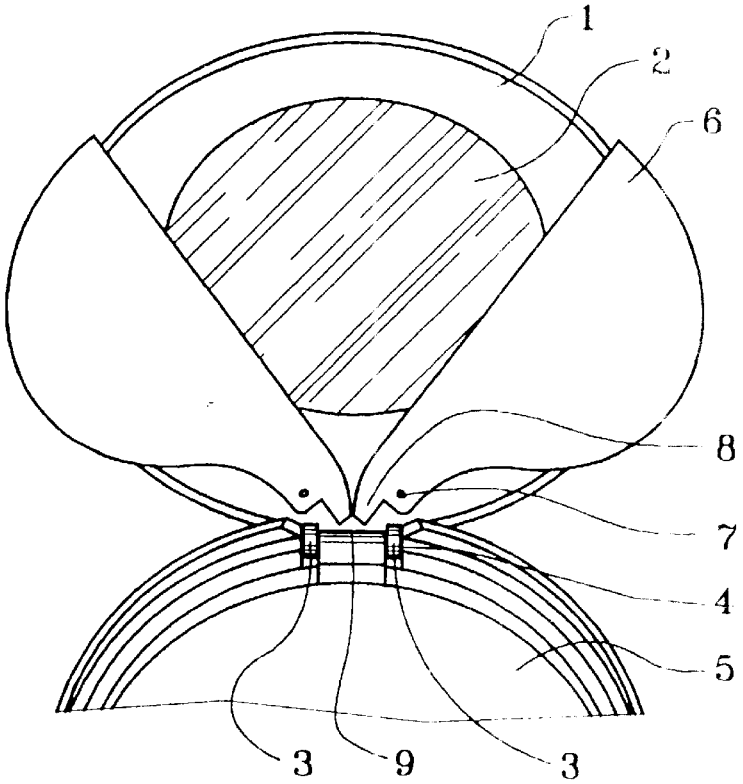
FIG. 1 is a schematic perspective view of a portion of a box according to a first embodiment of the invention, in the course of opening.

According to a first embodiment (FIG. 1), the cover 1, provided with an internal mirror 2, comprises two tongues 3 disposed in two slots 4 of the bottom 5, the assembly being traversed by an articulation pin (not shown).

Two flaps 6 are mounted pivotally on the cover 1 each by respectively one lug 7 secured to the flap and disposed in an opening (not shown) of the cover. Beyond the lug 7, adjacent the articulation of the cover 1 on the bottom 5, each flap 6 is prolonged by a heel 8 bearing on an edge 9 of the bottom 5 which forms a cam profile such that, in the course of opening the cover, the flap 6 opens. Upon closing the cover 1, the flap 6 returns to its closed position by the action of a resilient means (not shown) such as a spring.

Figure 2:
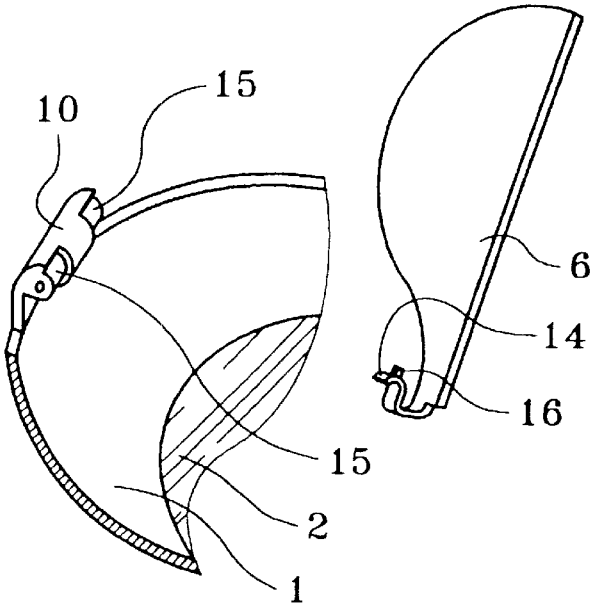
FIG. 2 is a schematic exploded perspective view of a flap and of the region of articulation of the cover, according to a modification of the invention.
Figure 3:
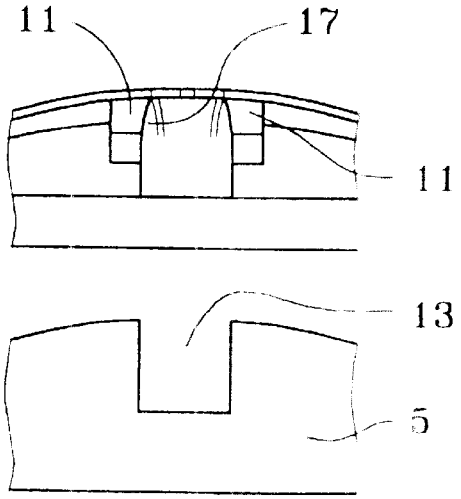
FIG. 3 is a schematic perspective exploded view of a portion of a ring, secured to the bottom, carrying the cam paths, for the modification of FIG. 2.

In the modification of FIGS. 2 and 3, the same reference numerals designate the same elements as in FIG. 1.

The cover 1 is provided with an articulation projection 10 mounted on a pin (not shown) passing through two articulation tongues 11 of a ring 8 secured to the bottom 5 and disposed in a notch 13 of this bottom 5.

Each flap 6 comprises a bearing prolongation 14 coacting with a respective projection 15 of the tongue 10.

The bearing projection 14 is provided with a lug 16 coacting with a cam path 17 provided on the internal side wall of an adjacent articulation tongue 11.

Upon opening and closing of the cover 1, the lug 16 follows the path of the track of the cam 17 in one direction and then in the other, such that the flap 6 pivots bearing on the projection 14 toward the exterior and then toward the interior.

What is claimed is:

1. A box for cosmetic products, comprising a bottom (5) adapted to receive at least one cosmetic product, a cover (1)

articulated on said bottom (5) and provided with a mirror (2) on its internal surface, and protective masks interposed between the bottom (5) and the cover (1) to protect said mirror (2), wherein the masks are constituted by two flaps (6) symmetrical relative to a plane perpendicular to the axis of articulation of the cover (1) on the box (5), each of said flaps (6) being assembled adapted to pivot about an axis adjacent its end adjacent said axis of articulation and substantially orthogonal to the latter, the flaps pivoting in a plane parallel to the plane of the cover.

2. A box for cosmetic products, comprising a bottom (5) adapted to receive at least one cosmetic product, a cover (1) articulated on said bottom (5) and provided with a mirror (2) on its internal surface, and protective masks interposed between the bottom (5) and the cover (1) to protect said mirror (2), wherein the masks are constituted by two flaps (6) symmetrical relative to a plane perpendicular to the axis of articulation of the cover (1) on the box (5), each of said flaps (6) being assembled adapted to pivot about an axis adjacent its end adjacent said axis of articulation and substantially orthogonal to the latter, and means for arranging the flaps to pivot away from each other in the course of opening the cover (1) and to pivot toward each other in the course of closing the cover (1).

3. A box according to claim 2, wherein the end of each flap (6) adjacent the axis of articulation of the cover (1) on the bottom (5) is mounted pivotably about an axis (8) perpendicular to the cover (1) and comprises a heel (8) coacting with a cam profile (9) carried by the bottom (5) of the box so as to cause said flap (6) to pivot toward the open position of the mask in the course of opening the cover (1), a resilient return means for ensuring the return of said flap (6) to the closed position in the course of closing the cover (1).

4. A box according to claim 3, wherein the pivoted ends of the flap (6) each comprise a lug (7) disposed respectively in an opening of said cover (1).

5. A box according to claim 2, wherein the end of each flap (6) adjacent the articulation of the cover (1) on the bottom (5) is provided with a prolongation (14) bearing on an articulation projection (10, 15) secured to the cover (1), said prolongation (14) being provided with a lug (16) coacting with a cam path (17) on the bottom (5).

* * * * *